US007413459B2

(12) United States Patent
Ho et al.

(10) Patent No.: US 7,413,459 B2
(45) Date of Patent: Aug. 19, 2008

(54) AUXILIARY DEVICE FOR A CONNECTOR

(75) Inventors: Lien-Hsun Ho, Taipei (TW); Yuan-Liang Hsu, Taipei (TW); Shou-Ting Yeh, Taipei (TW); Chuan-Hsing Wu, Taipei (TW); Tung-Yuan Chen, Taipei (TW); Chao-Yi Wu, Taipei (TW)

(73) Assignee: Cyber Power System Inc., Taipei (TW)

( * ) Notice: Subject to any disclaimer, the term of this patent is extended or adjusted under 35 U.S.C. 154(b) by 0 days.

(21) Appl. No.: 11/518,348

(22) Filed: Sep. 8, 2006

(65) Prior Publication Data

US 2008/0064249 A1 Mar. 13, 2008

(51) Int. Cl.
*H01R 13/627* (2006.01)

(52) U.S. Cl. ..... 439/352

(58) Field of Classification Search ..... 439/352, 439/476.1, 478, 480, 483, 484, 353, 357–358, 439/468

See application file for complete search history.

(56) References Cited

U.S. PATENT DOCUMENTS

| | | | | |
|---|---|---|---|---|
| 5,076,802 | A * | 12/1991 | Colleran et al. | 439/468 |
| 5,308,261 | A * | 5/1994 | Kightlinger | 439/358 |
| 5,580,268 | A * | 12/1996 | Miyazawa | 439/352 |
| 5,971,789 | A * | 10/1999 | Sukegawa | 439/352 |
| 2004/0192099 | A1 * | 9/2004 | Seminara et al. | 439/352 |

FOREIGN PATENT DOCUMENTS

JP 2005312647 A * 11/2005

* cited by examiner

*Primary Examiner*—Edwin A. León
(74) *Attorney, Agent, or Firm*—Alan Kamrath; Kamrath & Associates PA

(57) ABSTRACT

An auxiliary device for a connector has a body, a wire unit and plug. The wire unit is mounted securely in the body and extends out of the body from a first end of the body. The plug is formed on a second end of the body and is perpendicular to the wire unit. Therefore, the position of the wire unit is fixed when the plug is inserted into a socket.

6 Claims, 9 Drawing Sheets

AUXILIARY DEVICE FOR A CONNECTOR

BACKGROUND OF THE INVENTION

1. Field of the Invention

The present invention relates to an auxiliary device for a connector, and more particularly to an auxiliary device which is used to insert a plug into a socket.

2. Description of the Related Art

With the development of the industry, electrical devices are designed to be small to be portable.

With reference to FIGS. 8 and 9, a conventional power supply has a base (60) and a cap (61). The base (60) has a socket (62) and a wire unit (70) with a battery (72) mounted in the base (60) to supply power. A plug (71) is mounted on an end of the wire unit (70), and connects to the socket (62) to conduct power.

However, the socket (62) is mounted on a bottom of the base (60) and is mounted between the battery (72) and a shell such that the plug (71) is difficult to be inserted into the socket (62) by a finger of a user. Furthermore, the wire unit (70) is not fastened, so that the position of the wire unit (70) is not fixed. When the cap (61) is closed on the base (60), the cap (61) is easy to be blocked by the wire unit (70).

Therefore, the invention provides an auxiliary device for a connector to mitigate or obviate the aforementioned problems.

SUMMARY OF THE INVENTION

The main objective of the present invention is to provide an auxiliary device for a connector which can be used for inserting a plug into a socket.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
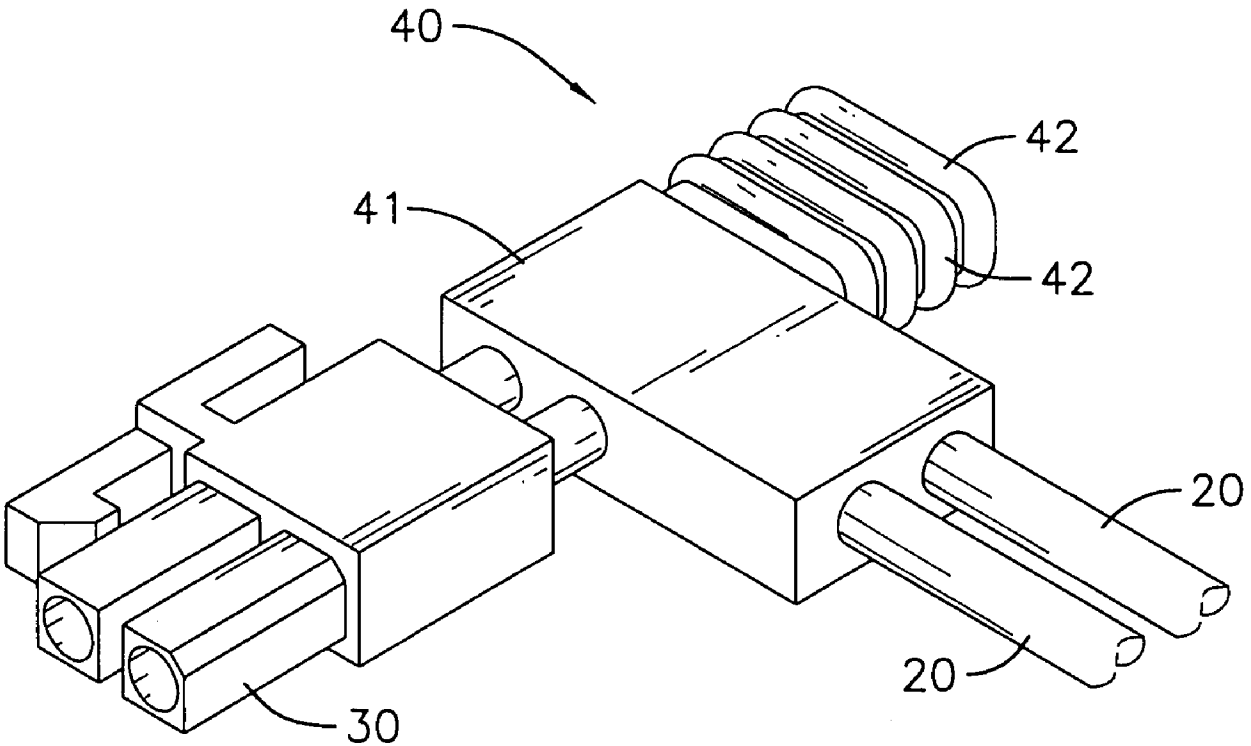
FIG. 1 is a perspective view of an auxiliary device for a connector in accordance with the present invention.
Figure 2:
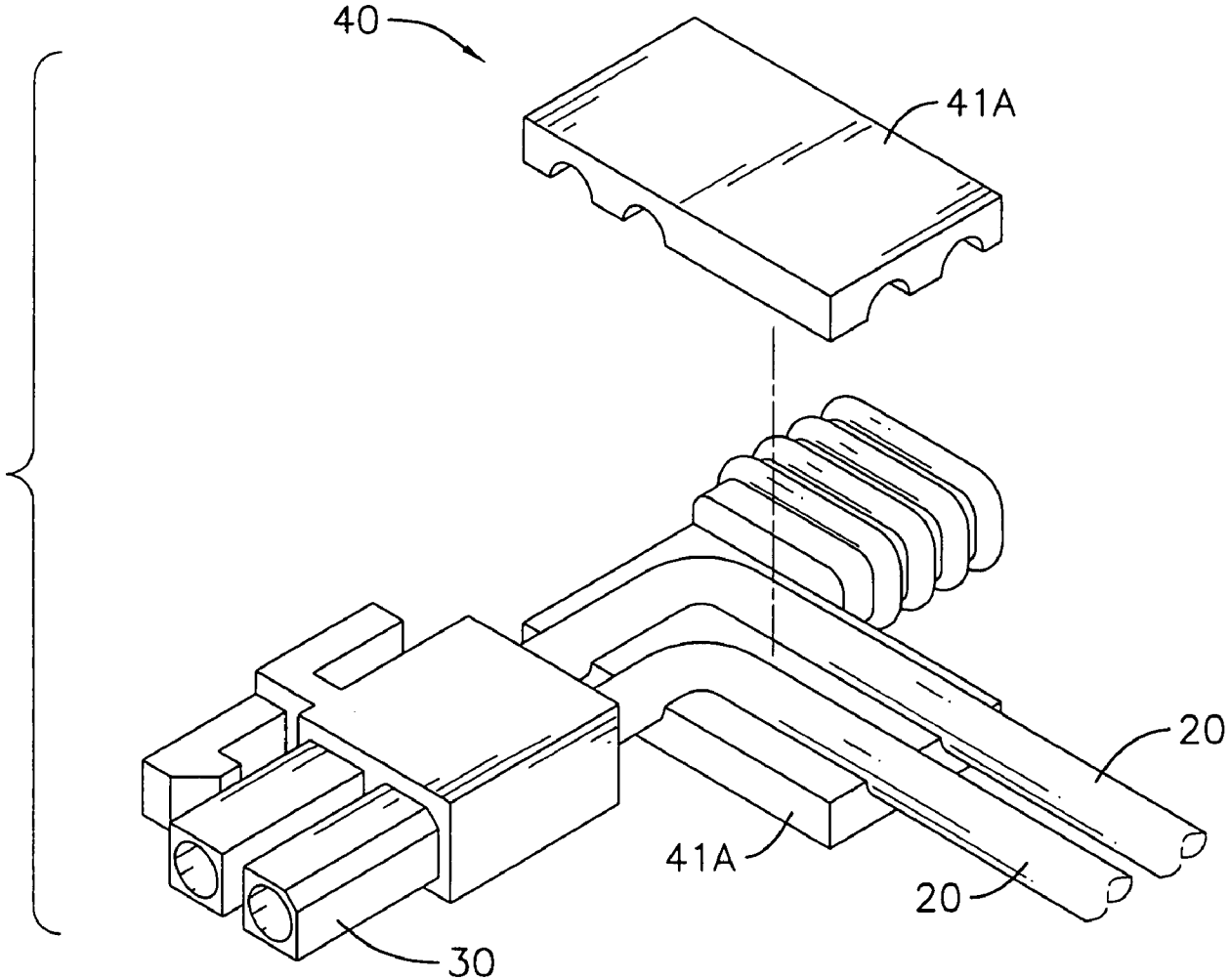
FIG. 2 is an exploded perspective view of the auxiliary device for a connector in FIG. 1.
Figure 3:
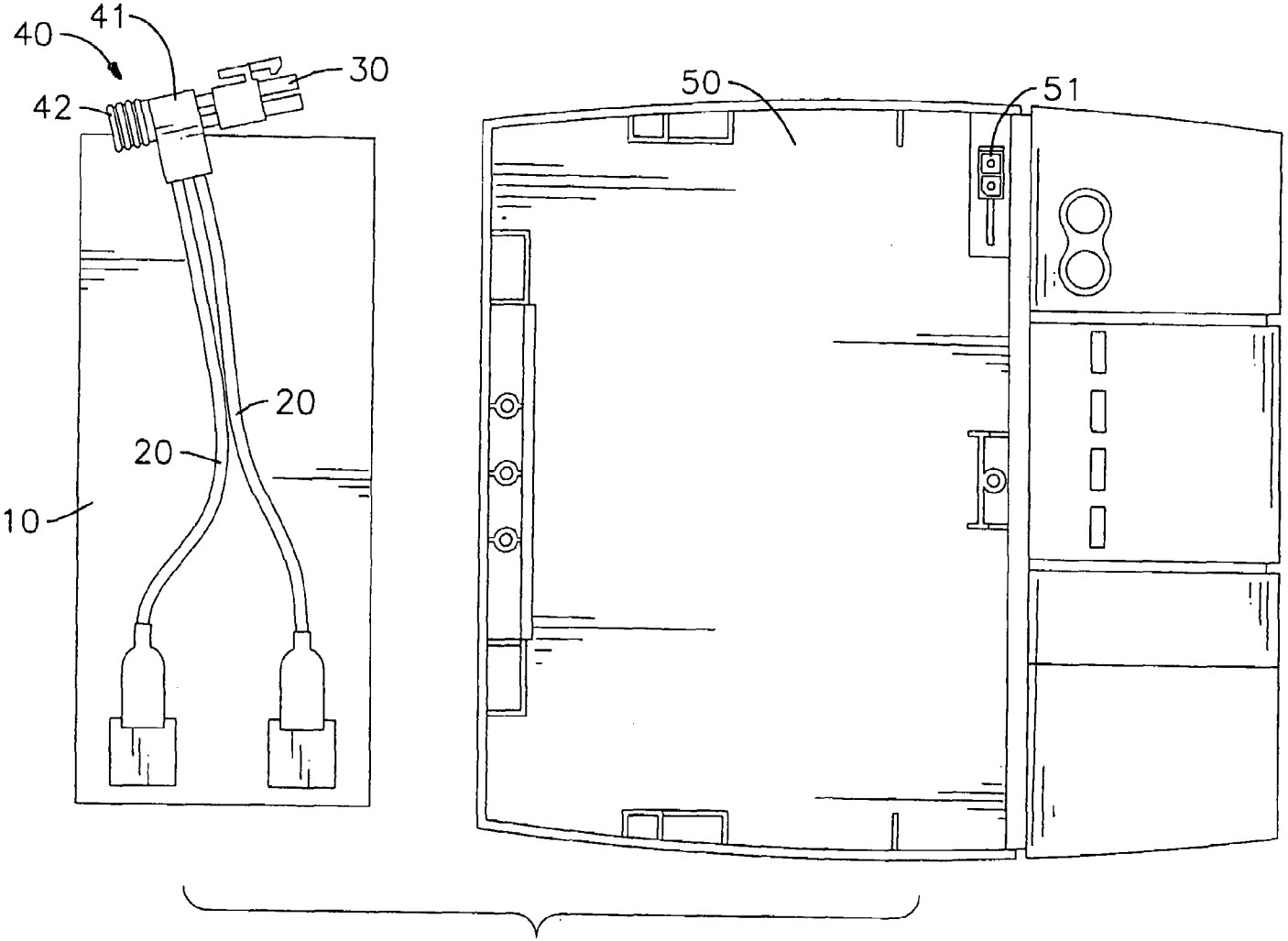
FIG. 3 is a top view of a power supply with the auxiliary device for a connector in FIG. 1.
Figure 4:
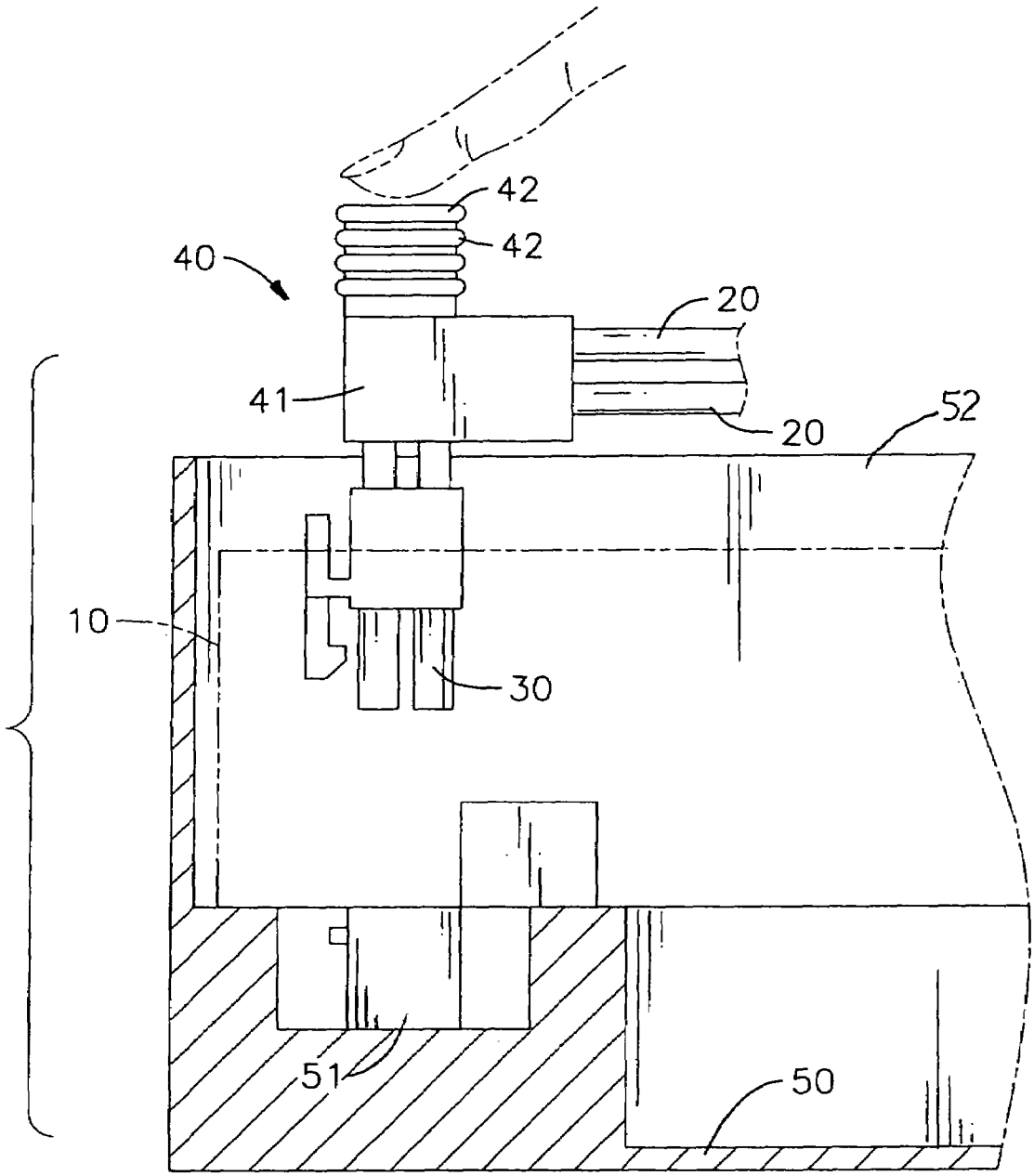
FIG. 4 is a partially enlarged operational side view in partial section of the power supply in FIG. 3.
Figure 5:
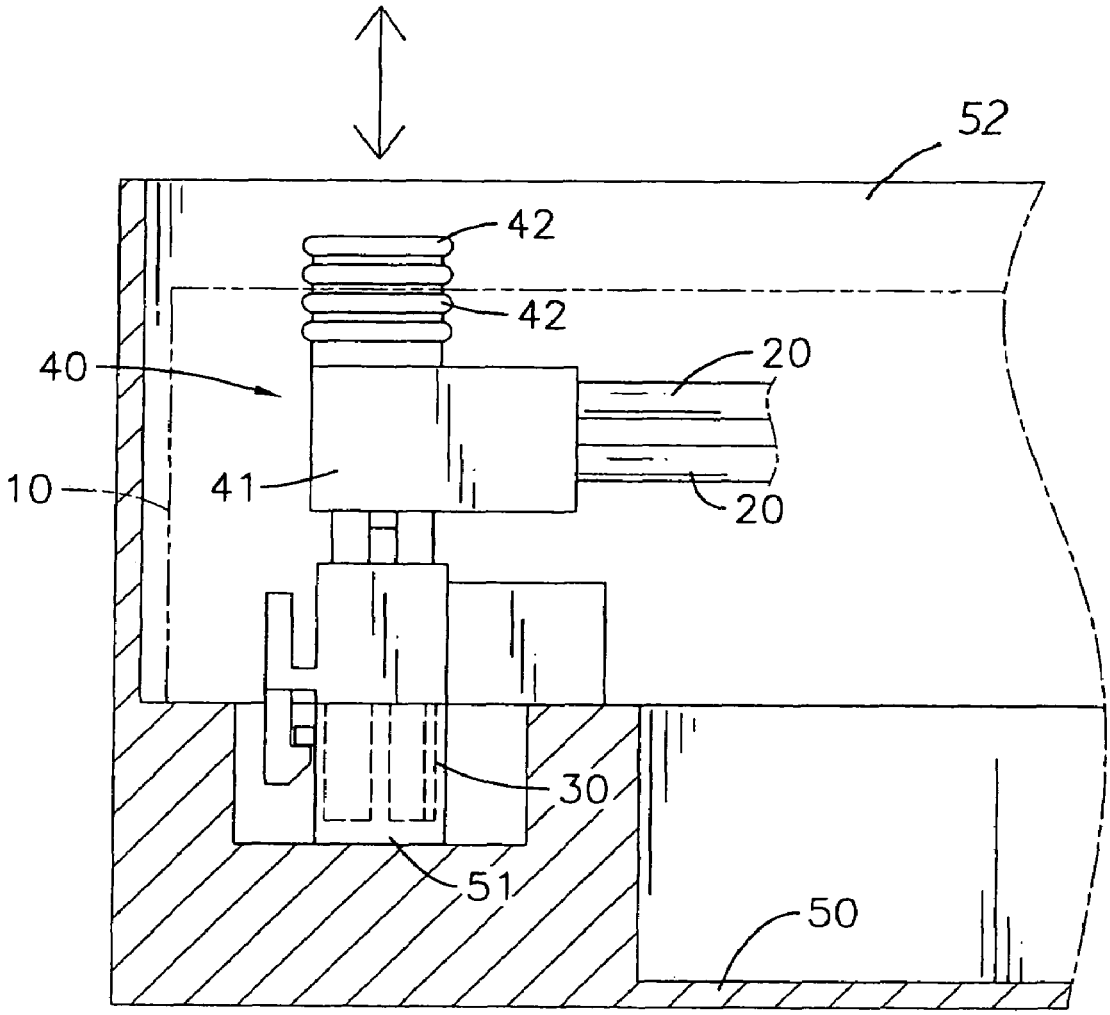
FIG. 5 is a partially enlarged operational side view in partial section of the power supply in FIG. 3 when a plug is inserted into a socket.
Figure 6:
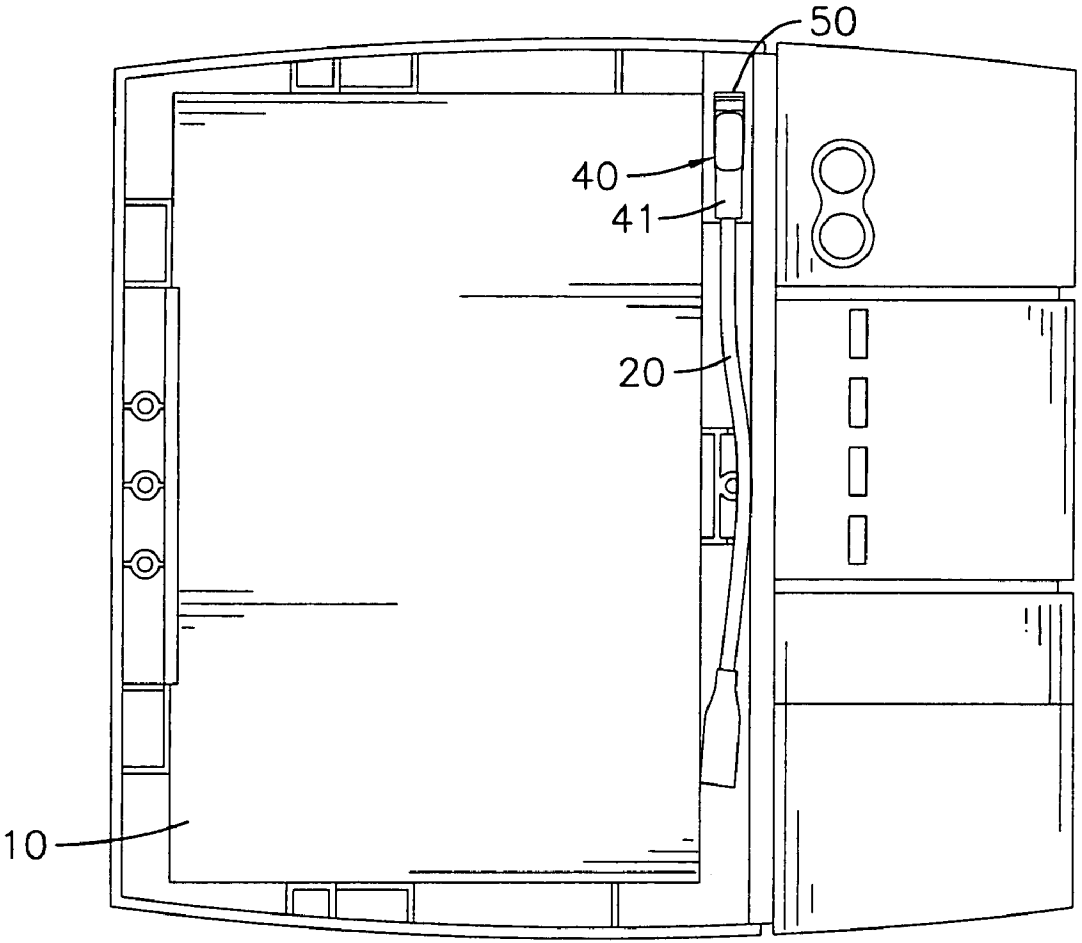
FIG. 6 is a top view of the power supply in FIG. 3 with the auxiliary device for a connector when the plug is inserted into the socket.
Figure 7:
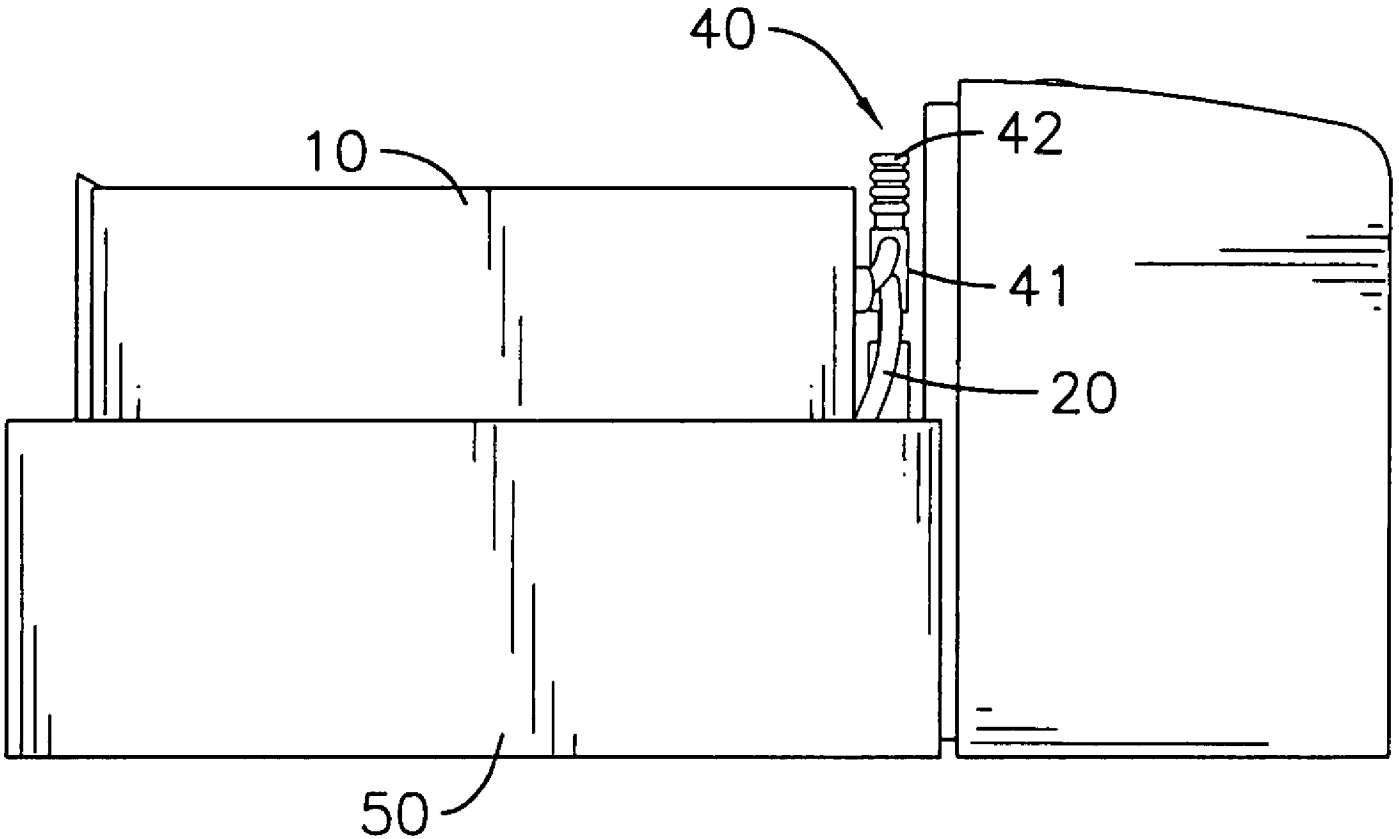
FIG. 7 is a front view of the power supply in FIG. 3 with the auxiliary device for a connector when the plug is inserted into the socket.
Figure 8:
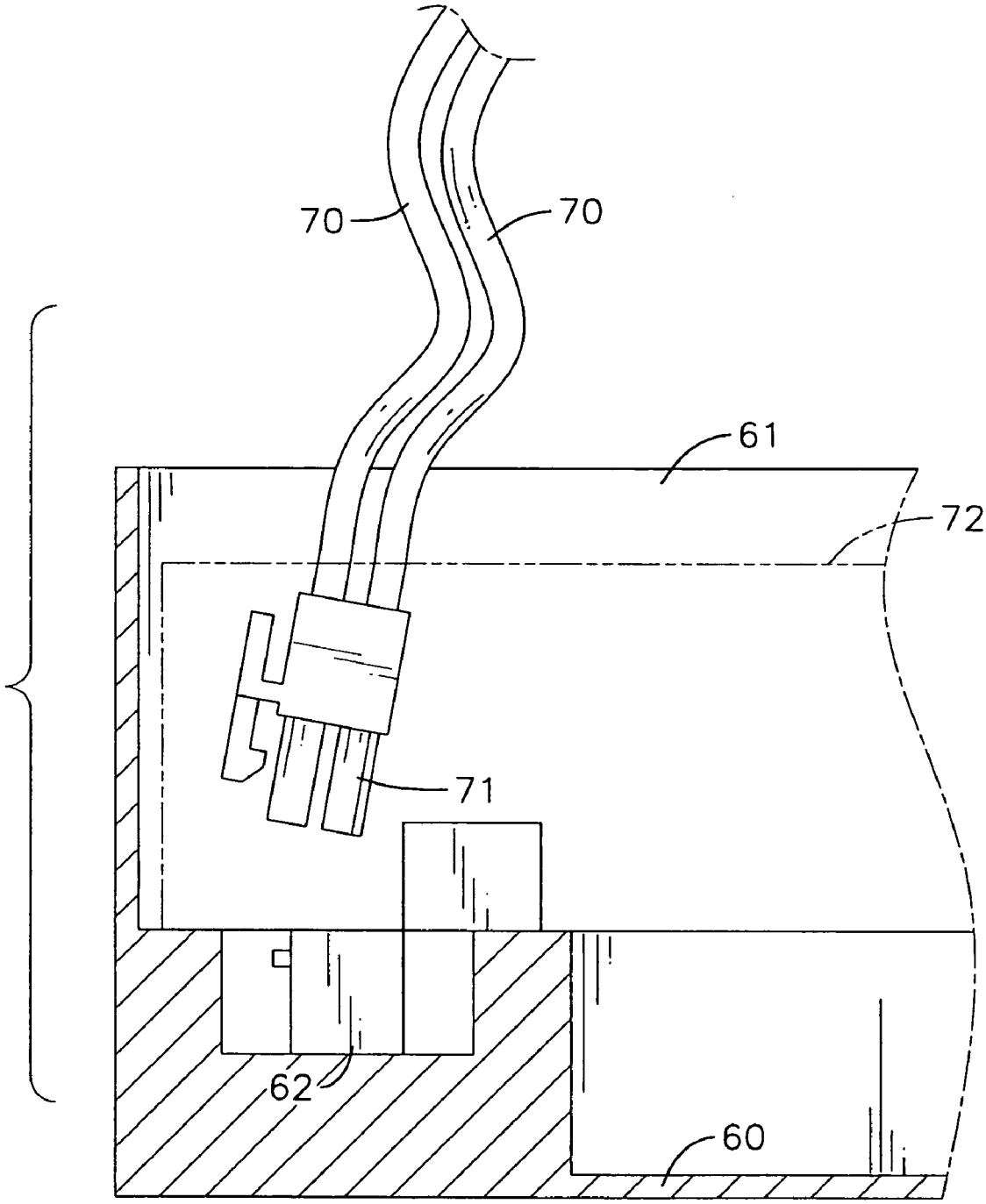
FIG.8 PRIOR ART
FIG. 8 is a partially enlarged side view in partial section of the conventional power supply in accordance with the prior art.
Figure 9:
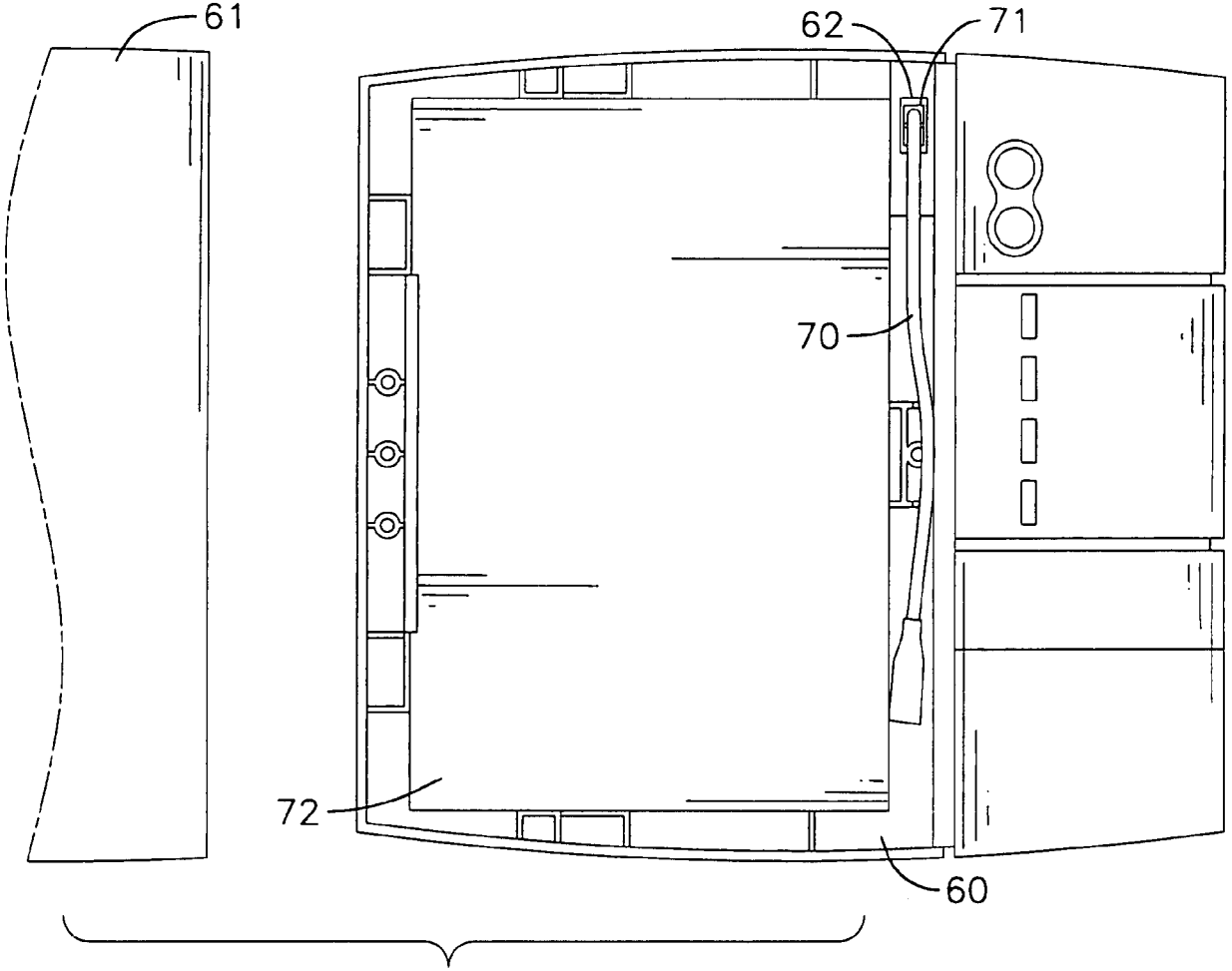
FIG. 9 PRIOR ART
FIG. 9 is a top view of the conventional power supply in FIG. 8.

With reference to FIGS. 1-3, an auxiliary device (40) for a connector in accordance with the present invention is made of plastic, has an L-like shape and connects to a power supply with an electrical device (10). The auxiliary device (40) has a body (41), multiple evenly-spaced ribs (42) formed in a third end of the body (41), a wire unit (20) and a plug (30).

The electrical device (10) has an anode and a cathode.

The wire unit (20) is formed transversely in the body (41) and extends out of a first end of the body (41) and opposite to a fourth end of the body. An end of the wire unit (20) is connected to the anode or the cathode of the power supply. The plug (30) is mounted in a second end of the body (41), opposite to the multiple, evenly spaced ribs (42) and is perpendicular to the wire unit (20). The second and third ends extend between the first and fourth ends of the body (41). The position of the wire unit (20) is fixed relative to the body (41).

The body (41) may have two separate portions 41A.

An electrical product has a base (50), a socket (51) formed in the base (50), and a cap (52). With further reference to FIG. 4-7, the electrical device (10) is provided on the base (50). With the ribs (42), the user can conveniently hold the plug (30) to insert into and to engage the socket (51).

Furthermore, the wire unit (20) can be positioned so that the cap (52) can be smoothly mounted onto the base (50).

It is to be understood, however, that even though numerous characteristics and advantages of the present invention have been set forth in the foregoing description, together with details of the structure and function of the invention, the disclosure is illustrative only. Changes may be made in details, especially in matters of shape, size, and arrangement of parts within the principles of the invention to the full extent indicated by the broad general meaning of the terms in which the appended claims are expressed.

What is claimed is:

1. An auxiliary device for a connector comprising:

a body having first, second, third and fourth ends, with the second and third ends being spaced and extending perpendicularly between both the first and fourth ends, with the first and fourth ends being spaced;

a wire unit mounted transversely in the body and extending out of the first end of the body opposite to the fourth end;

a plug mounted in the second end of the body and being perpendicular to the wire unit; and multiple evenly spaced ribs formed on the third end of the body, and opposite to the plug and intermediate and extending beyond the second and fourth ends, with each of the multiple evenly spaced ribs being parallel to the third end and of an annular shape parallel to the third end, with the multiple evenly spaced ribs being spaced from each other in a direction perpendicular to the third end and opposite to the second end, with the direction being parallel to the first and fourth ends, with the wire unit being intermediate the multiple evenly spaced ribs and the plug, with the multiple evenly spaced ribs being held by a user to insert the plug.

2. The auxiliary device for a connector as claimed in claim 1, wherein the body is one-piece and is made of plastic.

3. The auxiliary device for a connector as claimed in claim 1 wherein the multiple evenly spaced ribs are immovable relative to the third end of the body and integrally formed as a single, inseparable piece with at least a portion of the third end.

4. The auxiliary device for a connector as claimed in claim 1, wherein the body comprises two portions.

5. The auxiliary device for a connector as claimed in claim 3 wherein each of the two portions includes a part of each of the first, second, third and fourth ends, with the multiple evenly spaced ribs integrally formed as a single, inseparable piece with one of the two portions and being formed separably from and separable from another of the two portions.

6. The auxiliary device for a connector as claimed in claim 5 wherein the two portions are symmetrically formed.

* * * * *